US005699657A

United States Patent [19]

Paulson

[11] Patent Number: 5,699,657

[45] Date of Patent: Dec. 23, 1997

[54] BRAIDED LINE SPLICES AND METHODS OF SPLICING TO FORM SAME

[76] Inventor: William Thomas Paulson, 1073 Long Beach Dr., Big Pine Key, Fla. 33043

[21] Appl. No.: 652,818

[22] Filed: May 23, 1996

[51] Int. Cl.[6] ..... D01H 17/00

[52] U.S. Cl. ..... 57/22; 28/142; 57/25; 57/202; 87/12; 87/13

[58] Field of Search ..... 57/22, 23, 25, 57/202; 87/12, 13, 53; 28/142; 24/38

[56] References Cited

U.S. PATENT DOCUMENTS

| | | | |
|---|---|---|---|
| 2,549,382 | 4/1951 | Mitterway | 28/142 |
| 2,600,395 | 6/1952 | Domoj et al. | 28/142 |
| 4,036,101 | 7/1977 | Burnett | 87/8 |
| 4,099,750 | 7/1978 | McGrew | 289/1.5 |
| 4,974,488 | 12/1990 | Spralja | 87/8 |
| 5,062,344 | 11/1991 | Gerker | 87/8 |

*Primary Examiner*—William Stryjewski
*Attorney, Agent, or Firm*—D. D. McGraw

[57] ABSTRACT

Braided line splices and methods of making such splices using an inverted sleeve formed from a part of the braided line sheath, the steps forming the sleeve being at least a part of the method. The sleeve is formed by inverting it (turning it inside out), and then running a braided line part through the sleeve, tensioning the sleeve and having it grip the line part within the sleeve. Variations include making eye splices, both slipping and non-slipping; belt or loop splices, both slipping and non-slipping; and butt splices. Kits may be packaged which provide the necessary items and information to complete such splices.

20 Claims, 2 Drawing Sheets

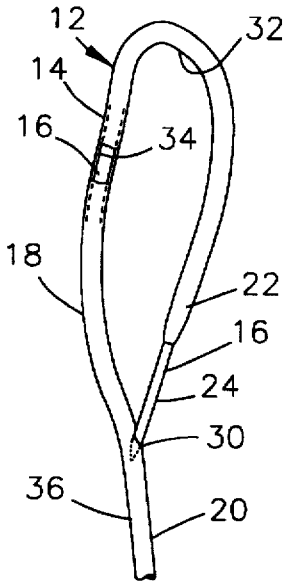
FIG. 1
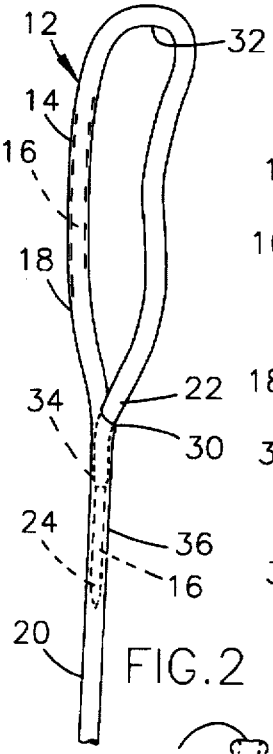
FIG. 2
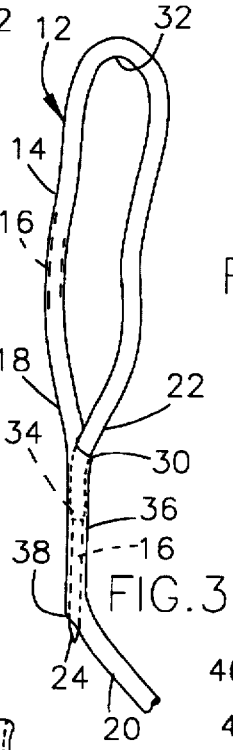
FIG. 3
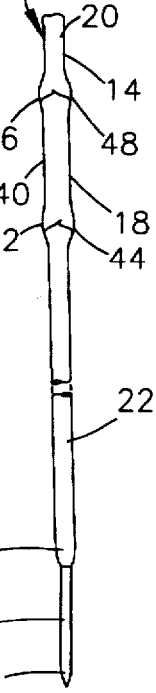
FIG. 1a
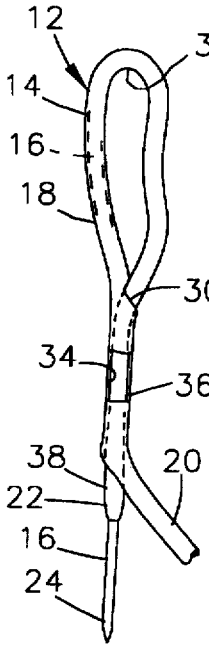
FIG. 4
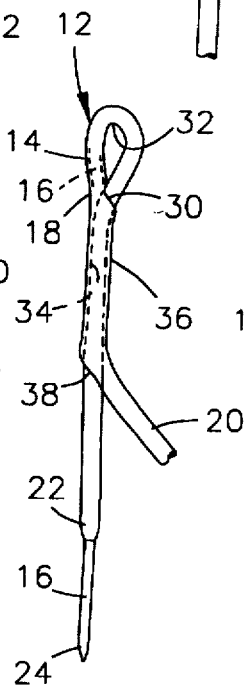
FIG. 5
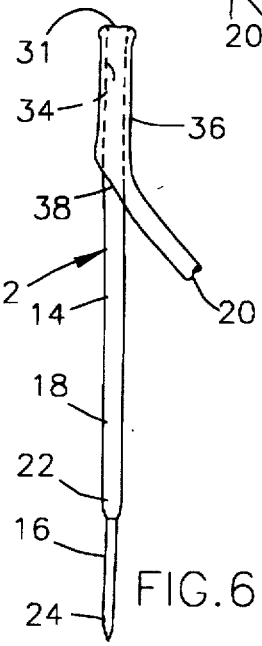
FIG. 6
FIG. 7
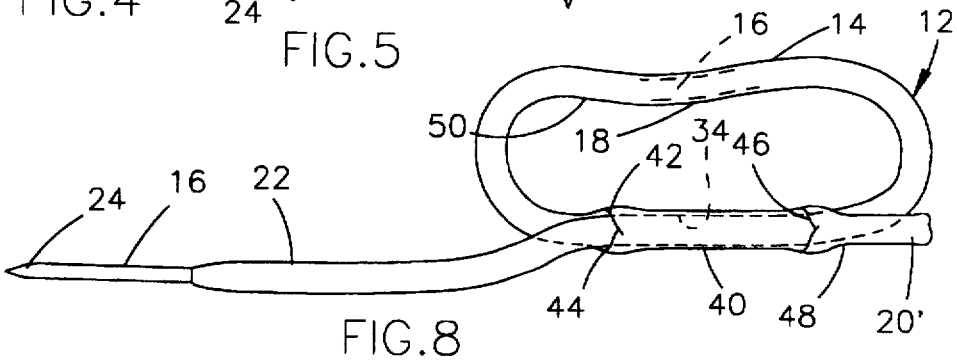
FIG. 8

BRAIDED LINE SPLICES AND METHODS OF SPLICING TO FORM SAME

FIELD OF THE INVENTION

The invention relates to braided line splices including slipping and non-slipping braid splices and butt splices, as well as methods for making such splices in braided line.

BACKGROUND OF THE INVENTION

Braid line or rope splicing has been in common practice for many years. Braid splices are used in various occupational and utility contexts, one of the most common of which is in maritime occupations or recreational boating. For simplicity, but without limitation, the background and the description of the invention herein disclosed and claimed will be primarily in that context. Such applications include use with mooring lines, sail reefing lines, sail cover ties, fender lines, adjusting lines for boat tops such as bimini tops, anti-chafe sleeves, and stevedoring. However, some aspects of the invention are useful in personal, household and other workplace areas ranging from belts to shoe laces, eyeglass ties, chin straps, mask retainers, tool retainers, various tie-downs from trash cans to car-top carriers and equipment covers, and even medical applications as tourniquets.

Braided line splicing is typically used to join two pieces of braided line together. A closed loop or eye may be formed in the end of a braided line so that the eye can be used to either be placed over an object such as a bollard or cleat, or, after the eye is formed, to have the bitter end of the line reeved through the eye to form a loop which can then be placed about an object so that the line has the eye end loop secured to the object. The remainder of the line is then used to either secure the object, control its movements, or provide the opportunity for the line to then be secured to another object which is in that manner secured to the first object; and various modifications of these basic arrangements.

The basic commonly-used techniques of splicing braided line are well known by most sailors as well as longshoremen. There are numerous seamanship manuals used to teach the art of working with all types of lines, including braided lines. Information, including comprehensive instructions for braiding, is also commonly provided by various braided-line manufacturers. In addition, there are numerous patents showing various arrangements, tools and methods for such braiding to form splices. Some examples of such patents are noted and described below.

U.S. Pat. No. 4,099,750-McGrew discloses a method of forming an eye splice in a double braided line wherein the fid or other tool may open up the braid and allow the end of the line to be drawn through the braid to form the loop. After the loop is formed, the core and sheath of the line are alternately pulled to tighten the crossover of the core and sheath and bury them in the sheath to complete the splice. Once so completed, the eye is then fixed as to its size.

U.S. Pat. No. 4,974,488-Spralja discloses a splicing apparatus and method for braided line. A fid is used to pass through the braid and draw the end of the line through the braid to form the splice. This eye is also then fixed as to its size.

U.S. Pat. No. 5,062,344-Gerker shows an eye splice used with a looping bight in one end of a hollow braid type of cord. The bight in the free end of the cord is folded back to form the eye of the looping bight. The free cord end of the bight has an eye spliced therein with the cord end extending through the braided wall of the cord at an entry point, then through the center of the cord to a take-out point, and then outwardly through the wall to provide a cinch loop or eye through which the standing part of the cord is passed. Essentially, this disclosure is that of a small, tight, fixed eye spliced into the cord free end by use of a previously well-known splicing technique, with the standing part of the cord being routed through the fixed eye to form a "lasso" type of slipping loop.

U.S. Pat. No. 4,036,101-Burnett also shows a fixed eye splice in a double braided hollow rope assembly.

An extensive search made in the U.S. Patent and Trademark Office through various subclasses of the Patent Office classification Classes 24, 28, 57, 87, 119 and 403, did not turn up any better background art than those patents noted above.

SUMMARY OF THE INVENTION

The invention involves a family of slipping braid splices, and the process or method of forming such splices. The splices employ integral or separate braid sleeves, formed from and as a part of a braided line sheath by an inversion process which is a part of the invention, in conjunction with one or more suitable cores. The inverted braid sleeve is a portion of the braid sheath that encloses and grips the core of a double braid line. It also may be a portion of a hollow braid which has been inverted. The use of hollow braid in practicing the invention will be described later. Under longitudinal tension, the inverted braid sleeve contracts in diameter, producing a gripping force on the enclosed core. When the inverted braid sleeve is compressed longitudinally, it expands in diameter, releasing its grip on the core. By applying such longitudinal compression to the inverted sleeve, the gripping sleeve is loosened from the core and can be moved to a desired location on the core. By then applying such tension to the sleeve ends, the gripping sleeve is fixed at that desired location on the core. When, with a splice used to form a closed loop such as an eye or a round or oval loop, it is desired to change the closed-loop size, such compression is once again applied to the sleeve ends, the gripping action of the sleeve is released from the core, and the sleeve and core are then moved relative to each other to either enlarge the closed loop diameter or reduce it. Once it is positioned to the desired size, the splice is again subjected to such tension as noted above, and the gripping sleeve once again grips the core.

The inverted braid sleeve can be an integral part of the double braid; that is, with double braid, the sleeve is a portion of the sheath with the core removed in order to permit insertion of the end of the double braid as a core. In order to retain the full strength of double braid at the splice section, the core is removed from the length of the sheath that will be inverted. After the sleeve is formed, the core is reinserted in the sheath except for the sleeve section where it parallels the sleeve, thus retaining the full strength of the double braid.

With hollow braid, different sections of the sheath function as the inverted sleeve and as the core. When the sheath and the core of the double braid are separated, they can each function in the same fashion as hollow braid.

Specific physical properties are required for successful inversion of a braid sheath. For example, the expanded internal diameter of the braid sheath must be slightly more than the compressed diameter of the core material so that the compressed core can pass through the expanded sheath during the inversion process. A related requirement for successful operation of the slipping splice is that the tip of the core must be slightly smaller than the expanded sleeve internal diameter in order to permit easy insertion and removal. Likewise, the expanded diameter of the sheath must not be substantially greater than the diameter of the core, or it will have no effective gripping action as a sleeve. Other factors to be considered are the frictional properties of the core and the sheath, the length of the sleeve, and the number of wall openings. Staple fibers result in a fuzzy surface with higher frictional or gripping qualities, while fine multifilament fiber bundles lower friction. Tightly twisted, denser fiber bundles provide better gripping action. The relatively slick, coarser fibers of traditional polyolefin hollow braid are relatively slippery and their use is not advised where higher gripping action is needed.

The method or process aspect of the invention includes the formation of suitable readily accessible openings in the wall of the braid sheath or jacket in order to form the splice sleeve. This is referred to herein as an inversion process, in which a portion of the braid sheath is inverted or turned inside out to form the sleeve. A temporarily-existing eye splice is formed in a hollow braid sheath by inserting a compressed braid tip through the sheath wall, using a fid if desired. The braid tip is pushed through the center of the braid sheath to the desired sleeve length and then passed out through the braid sheath wall. The tightly twisted strands forming the braid sheath are sufficiently large and well formed that the braid tip passes between the strands instead of splitting them. The braid tip is pulled as it exits from the sheath so that the braid core is pulled through the sheath portion that forms the sleeve, gradually reducing the size of the temporarily-formed splice eye. With continued pulling, the splice eye disappears at the entrance point to the braid sleeve. Still further pulling causes the section of the braid sheath to invert or turn inside-out as it is also pulled through the exit point, forming the inverted sleeve.

This creates a pair of well-defined openings in the braid sheath at the entry and exit points of the sleeve. The openings of a pair face in opposite directions either on the same or on opposite lateral sides of the braid sheath. These inversion-created openings provide permanent and easily accessible entry and exit points to form the braid splice. In addition to this pair of entry and exit openings, there are additional secondary openings on the opposite side of the braid sheath from the respective entry and exit points. These secondary openings face in the opposite directions from the primary openings. These secondary openings are an essential feature for some splice applications.

The entry and exit points can be placed on the same or on opposite sides of the braid sheath depending upon the end use requirements. The length of the sleeve can be varied, and a plurality of sleeves can be created and used. If the inverted sleeve is located near the end of the braided length of line, it is desirable to have a tab or tail on the end of the sleeve to assist in tensioning or release of the splice. At times, the tab is all that remains of the standing part. See the closed-loop belt splice of FIG. 12, for example. The tab is particularly useful in such a splice.

In the limiting version of the braid splice, instead of inserting the braid tip through the sheath wall and passing it through a length of the sheath before exiting to form the sleeve by inversion, the tip is inserted directly through the sheath, exiting on the opposite side. The inversion process now produces a well-defined "hole" in the braid sheath. These "holes" can be used to insert braid cross-members to form a bridle which may be used, by way of example, as a set of ties for a mainsail or a cover for a trailer boat or a tarpaulin.

After the sleeve has been formed by the inversion process, the braid splice is formed. It may be a butt splice or a closed-loop splice such as a belt splice or an eye splice. The butt splice is used to join two lengths of braided line, which may be adjusted or even taken apart when desired. The belt splice is particularly useful as an slipping splice which retains its adjusted position upon being tensioned, but is easily released for adjustment. Its closed loop is oval or rounded. The belt splice may also be made as a non-slipping double belt splice which has a significantly higher gripping power than the slipping belt splice. The eye splice may be either a slipping version or a non-slipping version. Its closed loop is tear-drop shaped. A braid splice embodying the invention may be an integral splice which involves a braid sleeve that is an integral part of the braid sheath, with the main body of the braid functioning as the braid core. In a modified arrangement, the braid splice may be a separate splice having a joined pair of separate braid sleeves that utilize separate cores, or in the case of butt splices, one, two, or more pairs of separate braid sleeves using separate cores. When using a butt splice to join two braided lines, each line has one or more braid sleeves and also provides one of the cores. Similar splices may be used to join more than two lines together at the splice junction.

BRIEF DESCRIPTION OF THE DRAWINGS

FIGS. 1 through 7 are schematic representations showing the steps of making an inverted sleeve in a length of braided line, after which a closed loop splice or a butt splice may be made, all in accordance with the invention.

FIG. 1*a* shows a typical fid that may be used as desired.

FIG. 8 schematically shows a slipping belt splice forming a belt having a rounded or oval closed-loop and securing the belt ends together.

DETAILED DESCRIPTION

In order to make the splices shown in FIGS. 8 THROUGH 15, one or more sleeves must be made in one or more lengths of braided line. These sleeves may be made in the manner illustrated in FIGS. 1 through 7. By first describing one of the splices to be made, there will be a better understanding of the need and manner of making the inverted sleeves which are requisite preliminaries to making a completed splice. Therefore, the splice in FIG. 9 will be first described to a sufficient extent that the disclosure of FIGS. 1 through 7 are better understood.

Figure 9:
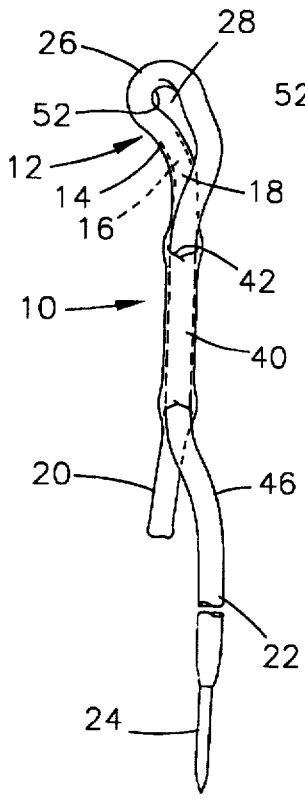
FIG. 9 is a somewhat schematic representation of an integral closed-loop adjustable braid eye splice of the slipping type embodying the invention.

The integral eye splice 10 of FIG. 9 is made in a length of double braided line 12, which has a body 14 comprised of a core 16 and a jacket or sheath 18 surrounding the core. Splice 10 of FIG. 9 is a slipping eye splice. Line 12 has a standing part 20 extending beyond the splice 10 to form the tab, also identified as 20. Line 12 also has an end 22 commonly referred to as the bitter end of the line. The bitter end 22 has a tip 24 at its extremity.

The line standing end tip 24 is preferably smooth, somewhat rigid, and tapered. Its diameter is slightly smaller than the expanded diameter of the body of the braided sheath or jacket 18 where the splice is to be made. If the tip is not sufficiently rigid, a suitably sized fid can be used as a tip to perform the inversion which results in the formation of the splice sleeve. The formation of the splice inverted sleeve is shown in FIGS. 1 through 7 and will be described below.

The body of the length of line 12 has a bight 26 formed from a reversely bent or looped part of that body extending between the end 22 and the splice 10. Eye 28 is formed by the bight 26 of the line body 14 and the splice 10. In one typical use of a line having an eye splice in one end, the eye 28 is fitted over a bollard on a dock or pier and the standing part 20 is led aboard a boat through a chock and secured to a cleat on the boat. Before so securing it, the standing part is often gripped by the hands of a boat crewman or a shore hand, and the boat is pulled into position in relation to the dock before the standing part of the line is cleated. In this use, the line 12 is functioning as a mooring line or a dock line. It is therefore to be understood that the bitter end 22 is that portion of the line 12 which typically may connect the loop formed by the eye splice 10 to an object to which the line 12 is to be either secured or manipulated.

Before the slipping braid splice 10 of FIG. 9 is assembled, the inverted sleeve 40 is made. Referring now to FIG. 1, by first looping the line body 14 so that the braid tip 24 can be inserted, with the aid of a fid if desired, through the wall of the braided sheath 18 at a sleeve entry formed by opening 30. A fid 25 is shown in FIG. 1*a*. This can be done by the tip 24 if that tip is sufficiently rigid like a fid and is shaped like a fid, thus being fid-like. Any of several ways of making the braided line at the tip 24 more rigid may be used.

For example, when the braided line is made of a thermoplastic material such as Nylon or Dacron or similar synthetic fibers, the tip 24 may be heated to plasticize the thermoplastic braid strands and form the softened braid into the desired shape. A heated, shaped tip mold may be used for this purpose, or the plasticized tip may be manually rolled and shaped. The softened braid, when cooled, solidifies into a sufficiently hard tip to insert the tip 24 through the braided sheath wall, through the interior of the sheath, and then out of the sheath wall, all without the use of a fid.

Another way of making a sufficiently hard tip is by the use of a suitable adhesive or resin which will harden with the tip having been shaped to the desired tapered diameter. Some such adhesives are sold and used in marine supply stores as a liquid whipping for the end of a line. Thermoplastic or thermosetting resins can be molded to produce the desired tip.

In step A of the process of making the inverted sleeve 40, illustrated in FIG. 1, the tip 24 is inserted through the entry opening 30, which has been worked through the braided strands forming the braided sheath 18. In doing so, the closed loop 32 is formed by the part of the line body 14 between the opening 30 and the portion of the tip 24 entering that opening. In the process of inversion, the sheath also functions as the core in the forming of the sleeve.

In step B of the process of making the inverted sleeve 40, illustrated in FIG. 2, tip 24 is then pushed through the interior 34 of the braided jacket 18 in which the core 16 is located, as shown in FIG. 2, to the desired length of the sleeve 36 being created, either by pushing its hardened portion or by the use of a fid, or a combination of the two actions.

In step C of the process of making the inverted sleeve 40, illustrated in FIG. 3, tip 24 is then passed out through another opening 38 formed through the wall of the braided jacket 18 at sleeve exit 38. The braid strands of the braided jacket 18 are tightly twisted and sufficiently large and well formed so that the braid tip (and the fid if used) passes between the strands instead of splitting them as openings 30 and 38 are formed. Thus the braiding forming the sheath 18 is not weakened by this part of the method.

In step D of the process of making the inverted sleeve 40, illustrated in FIG. 4, the braid core 16 is then pulled through the sleeve 36, which is that portion of the braid sheath 18 between the sleeve entry opening 30 and the sleeve exit opening 38 as shown in FIG. 4.

In step E of forming the inverted sleeve 40, as the core 16 is pulled through the sleeve 36, the closed loop 32 is gradually reduced, as shown in FIGS. 4 and 5, until the loop disappears at the entry opening 30 of the braid sleeve 36, as shown in FIG. 6.

In step F of forming the inverted sleeve 40, continued pulling on the braid core 16 causes the section of the braided jacket forming the sleeve 36 to invert or turn inside out at the point of inversion 31 as it is then pulled through the exit opening 38, thus forming the inverted sleeve 40 as illustrated in FIG. 7.

Figure 11:
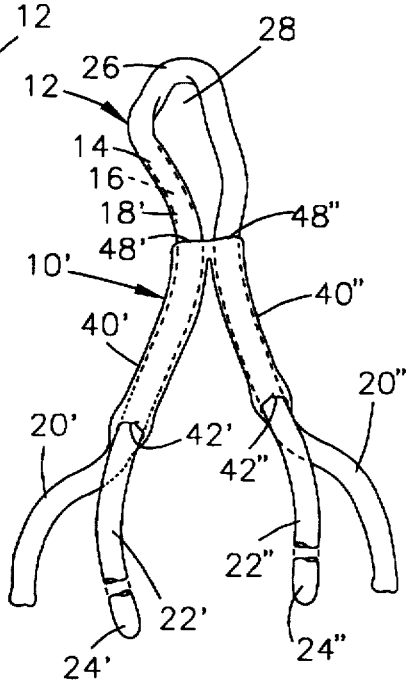
FIG. 11 is a similar representation still another slipping braid closed-loop eye splice embodying the invention, the slipping braid splice being a joined-pair-of-separate-sleeves eye splice.

This inversion process, when completed, results in step G of forming the inverted sleeve 40, which is the formation of a pair of well-defined entry and/or exit openings 48 and 44 at the sleeve entry and the exit points through which the core tip 24 has passed. These openings can be located on the same or the opposite diametrical sides of the braided line in lengthwise spaced relation along the length of braided line. This process also results in additional entry and/or exit openings 46 and 42 on the opposite inverted sleeve end from the openings 48 and 44. Openings 46 and 42 also face in the opposite directions. These openings are located on the opposite diametrical sides of the braided line so that openings 42 and 46 are respectively opposite openings 44 and 48. These two openings can be used for additional closures, an example of which is shown in FIG. 11.

As shown in FIG. 8, a closed-loop slipping belt splice may be made from a length of braided line 22 in which the inverted sleeve 40 has been made, as above described, near the end of the standing part 20 of the line. The tip 24 is inserted through the inverted sleeve entry opening 48 and exit opening 44 to form the slipping braid belt splice. In this arrangement, the standing part 20 and the bitter end 22 of line 12, on which tip 24 was formed, extend in opposite directions from opposite ends of the inverted sleeve 40 to form a round or oval closed loop 50, while, in the eye splice shown in FIG. 10, the standing part 20 and the bitter end 22 extend in the same direction from the sleeve 40 so that the closed loop 52 has an eye 28 which has a tear-drop shape. In FIG. 9, the standing part 20 and the bitter end 22 also extend in the same direction from the sleeve 40.

When used as a belt around a person's waist, for example, or around a package, it is readily adjustable to a smaller loop by pulling on the tip 24 while holding or pulling in the opposite direction on tab end 20. When the desired degree of tightness of the belt is attained, similar pulling on tab 20 and the part of the line body 14 forming the closed loop 50 near where the tip 24 is shown will cause the inverted sleeve 40 to grip the core 16 and any part of the line body located within the sleeve 40, preventing the closed loop from expanding. By pushing the opposite ends of the inverted sleeve toward each other, the gripping action is released, and the closed loop 50 may be expandably adjusted.

Returning now to the description of the eye splice of FIG. 9, the bight 26 is formed in the length of braided line between the inverted sleeve 40 and the bitter end 20. The tip 24 is then inserted in the entrance opening 42, pushed through the inverted sleeve 40, and exits the sleeve through exit opening 46. When tension is applied to the bitter end 22, the sleeve 40 slips on the core 16 because the sleeve 40 is not placed under tension by the bitter end 22. The eye 28 decreases in size until it tightly grips the bollard or other object enclosed by the eye. Additional tension on the standing part 20 causes the eye 28 to grip the enclosed object more tightly. The eye 28 can be enlarged by releasing the tension on the bitter end 22 and axially compressing the sleeve 40 to enlarge it by moving the ends 42 and 46 of the sleeve 40 toward each other.

Figure 10:
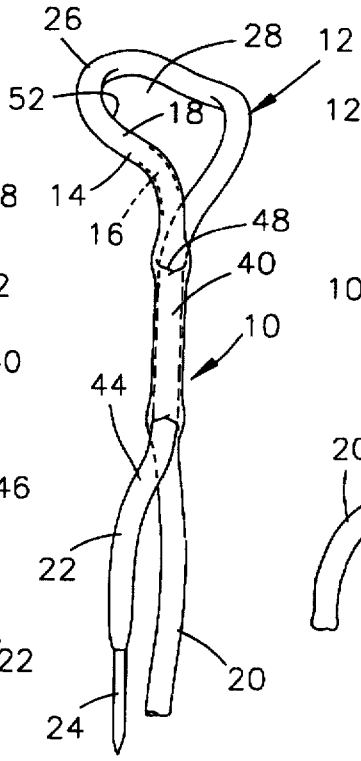
FIG. 10 is a similar representation of another braid eye splice embodying the invention, the braid splice being an integral closed-loop eye splice of the non-slipping type.

The eye splice shown in FIG. 10 is similar to that of FIG. 9, but is a non-slipping eye splice. Similar parts have the same reference characters. In this configuration, the sleeve 40 is formed from part of the length of line 12 which is near the standing part 20, and the tip 24 is passed through the entry opening 48, through sleeve 40, and out through the exit opening 44. As can be seen by referring to FIG. 7, these two openings are on the same diametrical sides of the line 12. The non-slip action occurs because the sleeve 40 is tensioned by force exerted through the standing part 20, causing the gripping action of the sleeve to hold the part of line 12 adjacent the bitter end 22 in place within the sleeve.

The double-sleeve eye splice 10' of FIG. 11 is of the type that can be used on shoe laces or draw strings, by way of example. The two joined sleeves 40' and 40" are formed adjacently from the sheath body 18'. Line 12 is a separate core that can be similar to or quite different from the braid sheath which has been inverted to form sleeves 40' and 40" No inverted sleeves are made as a part of the line 12. The sheath body standing parts form tabs 20' and 20" and their corresponding adjacent openings 42' and 42" are at the exit ends of sleeves 40' and 40" formed from the sheath body 18'. The two sleeves 40' and 40" are joined together at the entrance openings 48' and 48".

The line 12 has both ends formed with tips 24' and 24" on the core 16. The core bitter ends 22' and 22" from which tips 24' and 24" are formed may be well beyond the exit openings 42' and 42", as indicated in FIG. 11. In this arrangement, the line 12 may be a shoe lace, so that the entire line body 14 forms the lacing section from the bight portion 26 and the tips are merely the shoe lace ends. The splice 10' is tightened so that the sleeves 40' and 40" grip the line parts extending therethrough by pulling the core bitter ends 22' and 22" in an outward direction as seen in FIG. 11. The splice is loosened by pulling at the juncture of the sleeve entrance openings at 48' and 48".

Figure 12:
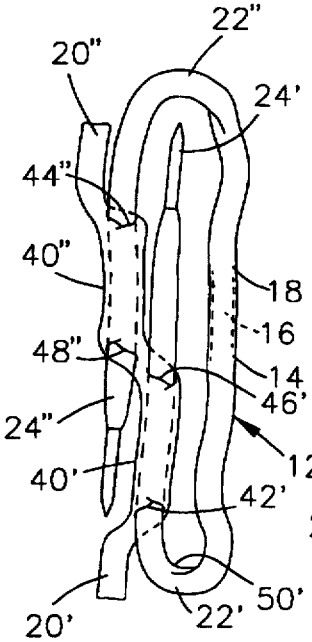
FIG. 12 schematically shows a closed-loop belt splice of the separate sleeve type.

FIG. 12 illustrates a double-sleeve belt splice using separate sleeves 40' and 40" similar to the separate sleeves used in FIG. 11, but with the sleeves joined adjacent to their laterally opposed openings 46' and 48'. The sleeves have tabs 20' and 20" respectively adjacent their entrance openings 42' and 44". The length of line 12 forming the belt part of the assembly has tips 24' and 24" formed on its respective end bitter ends 22' and 22". Tip 24' is inserted into opening 44' through sleeve 40' and out through opening 46'. Tip 24" is inserted into opening 44" through sleeve 40" and out through opening 48". The belt closed loop 50' is defined by the continuous portion of the length of line 12 not within the sleeves 40' and 40" as well at the portions within the sleeves and the sleeves themselves. The belt is "buckled" by pulling on tabs 20' and 20" in opposite directions to tension the sleeves 40' and 40", and released by pushing these tabs toward each other to relax the sleeves 40' and 40".

Figure 13:
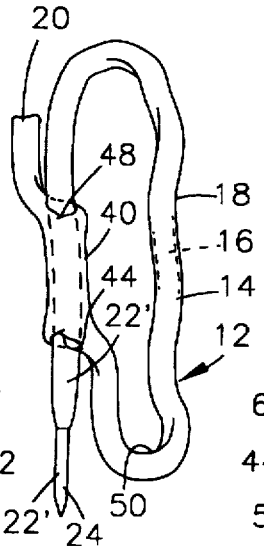
FIG. 13 schematically illustrates a closed-loop belt splice using an integral inverted sleeve and embodying the invention.

FIG. 13 is similar to FIG. 12, but uses a self-contained or integral sleeve 40 formed near the standing part 20 of one line end. Sleeve 40 has an entrance opening 48 and an exit opening 44 through which the tip 24, formed on the other bitter end 22' of the other line end, extends so that the portion of the line within the sleeve 40 is gripped by that sleeve when tightened by longitudinal tension force applied to the tab 20 formed on the entry end of sleeve 40. The belt closed loop 50' is defined by the portion of the length of line 12 not within the sleeves 40 as well at the portion within the sleeve and the sleeve itself.

Figure 14:
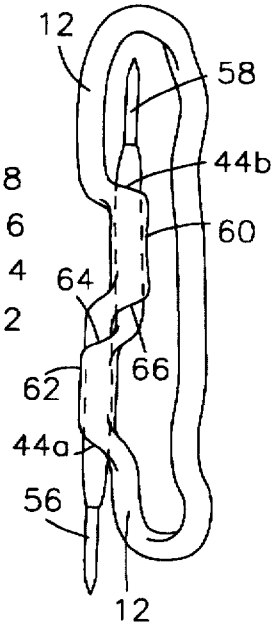
FIG. 14 schematically illustrates a non-slipping but adjustable double belt splice.

FIG. 14 schematically shows a non-slipping double belt splice embodying the invention. Instead of forming the tip and the gripping sleeve on the opposite ends of the braid, as shown in FIG. 8, the double belt splice uses tips 56 and 58 on the respective opposite ends of the braid, and suitably located inverted sleeves 60 and 62 adjacent the respective opposite ends of the braid. Tip 56 is inserted in the outer opening 64 of the inverted sleeve 62, and tip 58 is inserted in the outer opening 66 of the inverted sleeve 60, forming a belt with the two adjacent braid sleeves 60 and 62 being spaced apart. When the belt is tensioned, both sleeves 60 and 62 are placed in tension with resultant excellent gripping power. This splice is limited in decreasing-length adjustment since at a point in making such an adjustment the two sleeve ends 64 and 66 will meet and prevent further shortening of the belt. For most applications, the simpler belt splice of FIG. 8, even with its lesser gripping power, is quite adequate.

Figure 15:
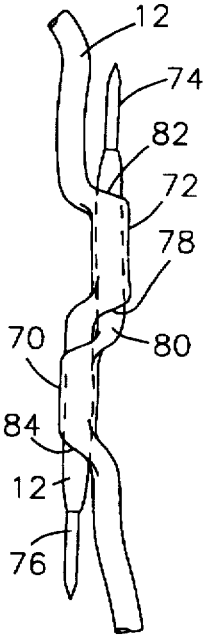
FIG. 15 schematically shows an integral sleeve overlapping butt splice embodying the invention and joining two braided lines together.

FIG. 15 shows a non-slipping double-sleeve butt splice 68 employing a similar technique to that shown in FIG. 14 to obtain significantly advantageous gripping power. An inverted sleeve 70, 72 is formed, by using a formed tip 74, 76 near each end of the two braid pieces that are to be joined. A fid may be used in forming the inverted sleeves 70 and 72 when desired, instead of using formed tips 74 and 76. The opposite tips 74 and 76 are respectively inserted into the corresponding inverted sleeve openings 78 and 80 in the two braid sections and out through the respective inverted sleeve openings 82 and 84. When tension is applied to the braid bodies 12 and 12' beyond the splice 68 connecting the now-joined braid sections, the splice has excellent gripping power. Whipping the exposed tips, or reinserting the tips into the braid sheath, provides a smoother splice. As an alternative, the tips can be inserted in the opposite ends of the splices, but this requires pulling the entire length of the braid sections through the corresponding sleeves. When tension is applied to the bitter ends of the braids, the sleeves are not placed in tension, but the two braid sleeves interlock, providing a secure butt splice.

When hollow braid is used, the sleeve is formed on one part adjacent one end, with that end becoming a formed end passing through another sleeve. In effect, in FIG. 9, the core 16 does not exist, so that the splice 10 comprises only the sleeve 40 through which another part of the hollow braid extends. This splice is then somewhat smaller in diameter than the splice shown in FIG. 9 because of the absence of the core 16, particularly in the area of the splice. It can be seen that other splices can be made of hollow braid which are comparable to the splices in the various FIGURES which are shown using double braid.

The invention may also be practiced with suitable braided line having the required compressed/expanded diameters. Such braids may be prepared for use in forming the splices shown and provided in a kit form. For example, a kit may include a suitable length of braided line (e.g., thirty feet of ⅝" braided line if a typical small craft dock line for which an eye on one end is to be constructed), a hardened tip such as is described above, or a fid, and instructions following the teachings of this disclosure on how to proceed to make either slipping or non-slipping tear-drop shaped eye splices or round or oval type eye, or belt, splices. The length of braided line may already have the inverted sleeve section or sections formed in it, or the instructions included may also include instructions for forming inverted sleeve sections.

Kits may also be provided with the line being small stuff in which the braided line is about the size of the typical shoe lace. The shoe lace may be laced onto the shoe and then the separate slipping braid splice such as that shown in FIG. 11 be used.

The disclosed and claimed splices have a broad range of applications. These include belts, laces, drawstrings, rigging, lashings, and numerous nautical functions. In many applications these splices are able to function in place of hook-and-loop fasteners, straps, buckles, knots and traditional splices.

I claim:

1. In a length of braided line, a closed-loop splice formed in said line by portions of said line, said braided line having a braided sheath and a core within said sheath, said core having an end portion at one end of said length of braided line and said sheath having a linearly extending inverted section spaced from said core end portion along said length of braided line with a plurality of openings formed through said sheath and opening into said inverted section of said sheath in lengthwise spaced relation along said length of braided line, said length of braided line also extending linearly beyond said sheath inverted section and forming another portion of said length of braided line which is selectively subjected to tension forces lengthwise thereof with such forces being exerted lengthwise through said sheath inverted section when occurring;

said core having said end portion thereof extending into a first one of said openings and through said sheath inverted section out of a second one of said openings so that a portion of said length of braided line between said core end portion and said sheath inverted section forms a closed loop, said sheath inverted section gripping said core end portion received therein.

2. In the length of braided line of claim 1, said core end portion extending in the same line linear direction from said second one of said plurality of openings as said another portion of said length of braided line which is selectively subject to tension forces extends from said sheath inverted section, whereby said closed loop provides an eye splice having a generally teardrop-shaped loop.

3. In the length of braided line of claim 1, said core end portion extending in the opposite line linear direction from said second one of said plurality of openings as said another portion of said length of braided line which is selectively subject to tension forces extends from said sheath inverted section, whereby said closed loop provides an eye splice having a generally rounded loop.

4. In the length of braided line of claim 1 in which said plurality of openings further includes third and fourth openings formed through said sheath and opening into said inverted section of said sheath respectively on diametrically opposite sides of said sheath from said first and second openings.

5. In the length of braided line of claim 4 in which said first opening is diametrically opposite said third opening and said second opening is diametrically opposite said fourth opening.

6. In the length of braided line of claim 5 in which said first and second openings are so circumferentially located on said braided line as to be on the same diametrical side thereof, and said third and fourth openings are so circumferentially located on said braided line as to be on a diametrical side thereof diametrically opposite the diametrical side on which said first and second openings are circumferentially located.

7. In the length of braided line of claim 5 in which said first and third openings are so circumferentially located on said braided line as to be on the same diametrical side thereof, and said second and fourth openings are so circumferentially located on said braided line as to be on a diametrical side thereof diametrically opposite the diametrical side on which said first and third openings are circumferentially located.

8. A braided line splice kit for making a braided line splice, said kit comprising:

a length of braided line having first and second ends and a line body between said ends formed by a braided sheath and a core within said sheath, means for forming a linearly inverted section spaced along said length of braided line from said first end of said length of braided line and a plurality of openings through said sheath and opening into said inverted section of said sheath in lengthwise spaced relation along said length of braided line;

means including one end of said core for leading that core end and at least a part of said core into a first one of said openings and through said sheath inverted section out of a second one of said openings to form a closed loop from the portion of said length of braided line between said core end and said sheath linearly inverted section so that said sheath inverted section grips the portion of said core received therein;

and instructions on how to proceed to make at least one of various types of splices such slipping or non-slipping tear-drop shaped eye splices or round or oval type eye, or belt, splices.

9. The braided line splice kit of claim 8 in which said means for forming a linearly inverted section of a portion of said sheath is a hardened fid-like end of said core and said core hardened fid-like end is also said means for leading that core end as aforesaid.

10. The braided line splice kit of claim 8 in which said means for forming a linearly inverted section of a portion of said sheath is a fid.

11. A method of splicing braided line having a core received in a braided sheath formed of braided strands, said method comprising the steps of:

(1) making an inverted sleeve for use in forming a splice in a braided line by the steps of:

(a) forming a hardened tip on one end of at least the core of the braided line;

(b) inserting the hardened tip through an entry opening of the braided sheath of the braided line by working the hardened tip through the braided strands forming the braided sheath, forming a closed loop by the part of the braided line between the entry opening and the entering part of the braided line where it enters the entry opening;

(c) moving the hardened tip through the interior of the braided sheath longitudinally of the braided line;

(d) then moving the hardened tip through an exit opening by again working it through the braided strands of the braided sheath to form an exit opening, thereby establishing the length of the sleeve defined by the part of the braided sheath between the entry and exit openings;

(e) passing the hardened tip out through the exit opening and continuing to move the portion of the braided line forming the loop through the sleeve to gradually reduce the closed loop until the loop disappears at the entry opening;

(f) then pulling on the part of the braided line that has passed through the sleeve, causing the section of the braided sheath forming the sleeve to invert or turn inside out as it is pulled through the exit opening, forming an inverted sleeve;

(g) and in so doing forming a pair of well-defined entry and exit openings at the inverted sleeve entry and exit points through which the hardened tip has passed;

(2) inserting one end of at least a part of the braided line into the entry opening and passing it through the formed sleeve until it has passed out through the exit opening;

(3) and applying longitudinally directed tension force to the sleeve so as to cause the sleeve to grip the portion of the braided line extending through the sleeve.

12. The method of claim 11 wherein the braided line is a double braid having a sheath and a core, with the inverted sleeve being formed from a portion of the sheath in step (1) and the core having the end which is passed through the sleeve in step (2) and the sleeve when tensioned grips the portion of the core extending through the sleeve in step (3).

13. The method of claim 11 in which the braided line is a hollow braid with the inverted sleeve being formed as a part of the hollow braid and the end being that of one end of the hollow braid forming the braided line.

14. The method of forming a braided line splice as set forth in claim 11 wherein the entry opening of the inverted sleeve is the sleeve opening nearer the end of the braided line so that when step (2) is performed a tear-drop shaped eye splice is formed by the portion of the braided line between the sleeve and the portion of the braided line extending into the entry opening.

15. The method of forming a braided line splice as set forth in claim 11 wherein the exit opening of the inverted sleeve is the sleeve opening nearer the end of the braided line so that when step (2) is performed a belt or oval loop-like splice is formed by the portion of the braided line between the sleeve and the portion of the braided line extending into the entry opening.

16. A method of making an inverted sleeve for use in forming a splice in a braided line having a core received in a braided sheath formed of braided strands, said method comprising the steps of:

(1) forming a hardened tip on one end of at least the core of the braided line;

(2) inserting the hardened tip through an entry opening of the braided sheath of the braided line by working the hardened tip through the braided strands forming the braided sheath, forming a closed loop by the part of the braided line between the entry opening and the entering part of the braided line where it enters the entry opening;

(3) moving the hardened tip through the interior of the braided sheath longitudinally of the braided line;

4) then moving the hardened tip through an exit opening by again working it through the braided strands of the braided sheath to form an exit opening, thereby establishing the length of the sleeve defined by the part of the braided sheath between the entry and exit openings;

(5) passing the hardened tip out through the exit opening and continuing to move the portion of the braided line forming the loop through the sleeve to gradually reduce the closed loop until the loop disappears at the entry opening;

(6) then pulling on the part of the braided line that has passed through the sleeve, causing the section of the braided sheath forming the sleeve to invert or turn inside out as it is pulled through the exit opening, forming an inverted sleeve;

(7) and in so doing forming a pair of well-defined openings at the inverted sleeve entry and exit points through which the hardened tip has passed.

17. The method of claim 16 in which in step (6) another set of entry and exit openings is formed respectively on the opposite ends of the inverted sleeve from the entry and exit openings formed in step (7).

18. Using the method of forming the inverted sleeve as set forth in claim 16, further forming a splice in the braided line by the additional steps of:

(8) inserting the hardened tip end through the inverted sleeve via the first the entry opening and then the exit opening thereof and forming a loop;

(9) and exerting longitudinal tension of the inverted sleeve, causing that sleeve to grippingly engage the portion of the braided line extending therethrough.

19. The method of forming a splice in accordance with claim 18 in which the entry opening through which the braided line end is inserted in step (8) is the sleeve opening nearer the end of the braided line so that when step (8) is performed a tear-drop shaped closed-loop eye splice is formed by the portion of the braided line between the inverted sleeve and the portion of the braided line extending into the entry opening.

20. The method of forming a splice in accordance with claim 18 in which the entry opening through which the braided line end is inserted in step (8) is the sleeve opening further from the end of the braided line so that when step (8) is performed a closed-loop belt splice is formed by the portion of the braided line between the inverted sleeve and the portion of the braided line extending into the entry opening.

* * * * *